United States Patent [19]

Russey

[11] 4,392,554

[45] Jul. 12, 1983

[54] LIFT MAST ASSEMBLY

[75] Inventor: James W. Russey, Chardon, Ohio

[73] Assignee: Towmotor Corporation, Mentor, Ohio

[21] Appl. No.: 322,301

[22] PCT Filed: Oct. 23, 1981

[86] PCT No.: PCT/US81/01422

§ 371 Date: Oct. 23, 1981

§ 102(e) Date: Oct. 23, 1981

[87] PCT Pub. No.: WO83/01434

PCT Pub. Date: Apr. 28, 1983

[51] Int. Cl.[3] ..... B66B 9/20

[52] U.S. Cl. ..... 187/9 E

[58] Field of Search ..... 187/9 E, 9 R, 95; 414/630, 631, 635, 785; 308/3 B, 3 R

[56] References Cited

U.S. PATENT DOCUMENTS

| | | | |
|---|---|---|---|
| 3,556,247 | 1/1971 | Shinoda et al. | 187/9 E |
| 3,999,267 | 12/1976 | Leskovec et al. | 29/148.4 A |
| 4,034,885 | 7/1977 | Stedman | 187/9 E |
| 4,124,104 | 11/1978 | Yarris | 187/9 E X |
| 4,191,276 | 3/1980 | Farmer et al. | 187/9 E |
| 4,219,302 | 8/1980 | Leskovec | 414/635 |
| 4,312,427 | 1/1982 | Stedman | 187/9 E |

*Primary Examiner*—Joseph J. Rolla
*Assistant Examiner*—R. Stormer
*Attorney, Agent, or Firm*—Alan J. Hickman

[57] ABSTRACT

This invention relates to an improved visibility free lift mast (10) which eliminates the problems of reduced lift height, upright strength and excessive guide bearing loading. The lift mast assembly (10) has a fixed upright (42) and a movable upright (52) mounted on the fixed upright and elevationally movable relative thereto. A lower guide bearing (80) is mounted on a lower end portion (78) of the movable upright (52) and an upper (88) and intermediate (98) guide bearing is mounted on an upper end portion (92) of the fixed upright (42). The intermediate guide bearing (98) is positioned between the upper and lower guide bearings (88,80) a preselected distance (D) spaced from the upper guide bearing (88). The movable upright (42) is elevationally movable a first preselected distance at which the movable upright (52) is contactable with the intermediate guide bearing (98) and free from contact with the upper guide bearing (88) and a second preselected distance at which the movable upright (42) is free from contact with the intermediate guide bearing (98) and contactable with the upper guide bearing (88). Thus an improved visibility lift mast with free lift has been provided which offers maximum lift height for a given upright length, superior upright strength, and sequenced roller loading for improved roller life. The lift mast assembly is particularly useful in a fork lift truck.

21 Claims, 3 Drawing Figures

88
84
106
118
122
46
122
106
84
90
118
120
92
124
II
134
134
92
120
124
126
34
126
II
136
136
94
98
32
94
100
138
40
12
14
42
52
36
44
54
24
10
22
28
28
48
18
26
20
16
30
38
30
38
114
78
114
F
116
116
102
74
80
78
110
50
58
110
82
74
102

FIG-2
2/2
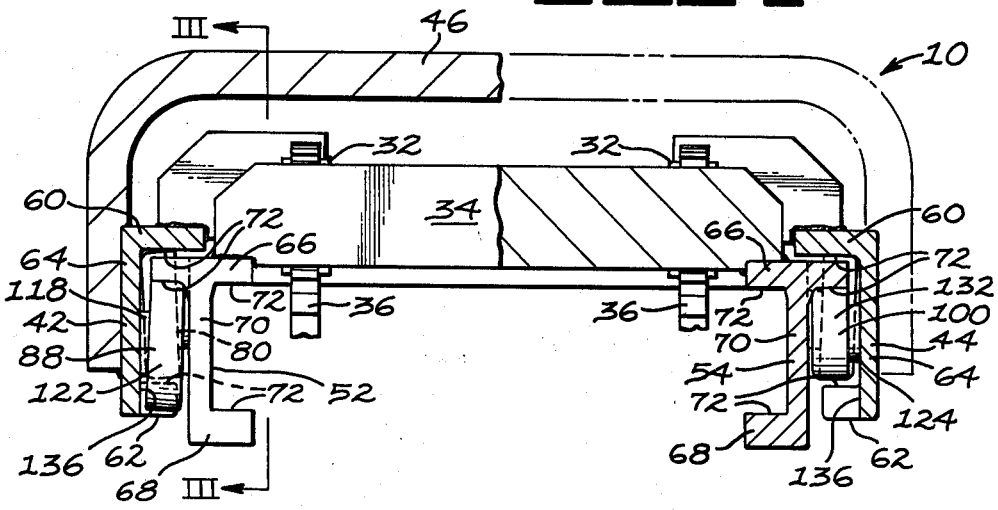
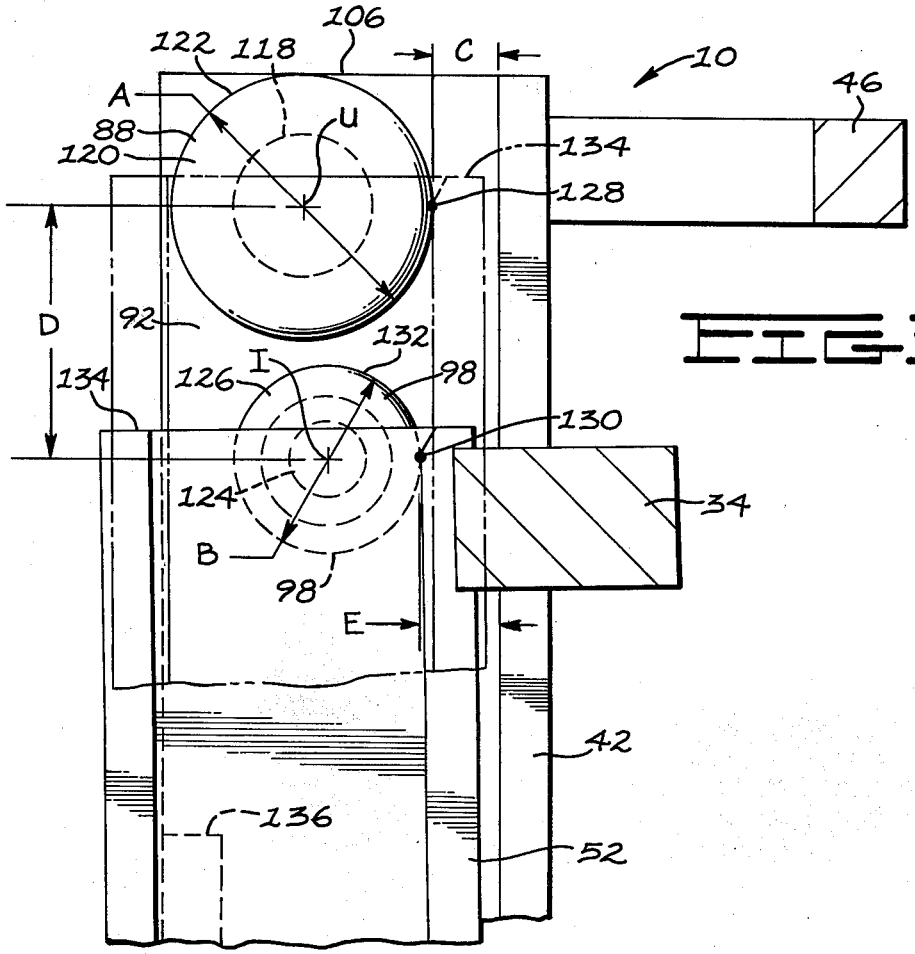
FIG-3

LIFT MAST ASSEMBLY

TECHNICAL FIELD

This invention relates to a lift mast assembly and more particularly to a lift mast assembly having first and second pairs of spaced apart uprights and upper intermediate and lower guide bearings. The intermediate guide bearings support and guide the second pair of spaced apart uprights for movement between a lowered position and an intermediate position spaced from the lower position and the upper guide bearings support the second pair of spaced apart uprights for movement between the intermediate position and a fully extended position.

BACKGROUND ART

In recent years it has been a goal of lift truck manufacturers to provide a lift mast, of the type used on a fork lift truck, with improved visibility and free lift. U.S. Pat. No. 4,219,302 dated Aug. 26, 1980 to Edward V. Leskovec and U.S. Pat. No. 4,191,276 dated Mar. 4, 1980 to Stanley E. Farmer disclose a lift mast having improved visibility and free lift. Free lift is well known in the art as elevational movement of a lift carriage prior to extension of a movable upright assembly past the upper end of the fixed or stationary upright assembly. Although these two designs both accomplish improved visibility and free lift they both require additional parts which tend to be complex in nature and add to the cost of the lift mast.

It is preferred that high visibility be achieved without any additional structure or parts while maintaining free lift as a feature thereof. In order to achieve this it has been determined that the movable lift mast uprights and particularly the upper end thereof be spaced elevationally beneath the upper end of the fixed uprights so that the movable uprights and particularly the carriage can move to a preselected elevated face lift position, from a fully lowered position, without the upper end of the movable upright passing the upper end of the fixed upright.

Typically, lift masts of this type require upper and lower guide bearing assemblies, such as rollers, to be provided between the fixed and movable uprights so as to guide the uprights smoothly so as to prevent sticking, bending, excessive wear and the like. Also, it has been accepted that the distance between the upper and lower guide bearings should be spaced as far apart as possible to offer the maximum amount of movable upright extension relative to the fixed upright for a given length as possible. However, placement of the movable upright beneath and spaced from the upper end of the fixed upright requires the upper guide roller to be moved downward to a location to support the upper end of the movable upright when in its lowered position or provide an additional guide roller adjacent the upper roller.

This added intermediate guide roller creates an additional series of problems. The total overall maximum height of extension of the movable upright assembly is reduced, separation of the mast sections for disassembly and maintenance are further complicated in that the cutout of the flange at the upper end portion of the fixed upright must be increased in length resulting in weakening of the strength of the fixed upright sections, and alignment of the upper and intermediate guide rollers to provide proper contact between the movable upright and the rollers to reduce premature wear, failure and alleviate the potential of binding of the movable uprights.

The present invention is directed to overcoming one or more of the problems as set forth above.

DISCLOSURE OF THE INVENTION

In one aspect of one embodiment of the present invention, a lift mast having a first upright and a second upright mounted on said first upright and elevationally movable relative thereto is provided. Upper, intermediate and lower guide bearings are provided for supporting and guiding the second upright on the fixed upright. The intermediate guide bearing contactably supports and guides the second upright when the second upright is elevationally positioned between a lowered and intermediate location and the upper guide bearing supports and guides the second upright when the second upright is elevationally positioned between said intermediate location and the fully elevated location.

BRIEF DESCRIPTION OF THE DRAWINGS

FIG. 2 is a diagrammatic top sectional view taken along lines II—II of FIG. 1 showing in greater detail the upper and intermediate guide bearings; and FIG. 3 is a diagrammatic view as seen in the direction of the arrows III—III of FIG. 2 showing the upper and intermediate guide bearings and the second upright in the lowered position in solid lines and between the intermediate and fully raised position in phantom lines.

BEST MODE FOR CARRYING OUT THE INVENTION

Figure 1:
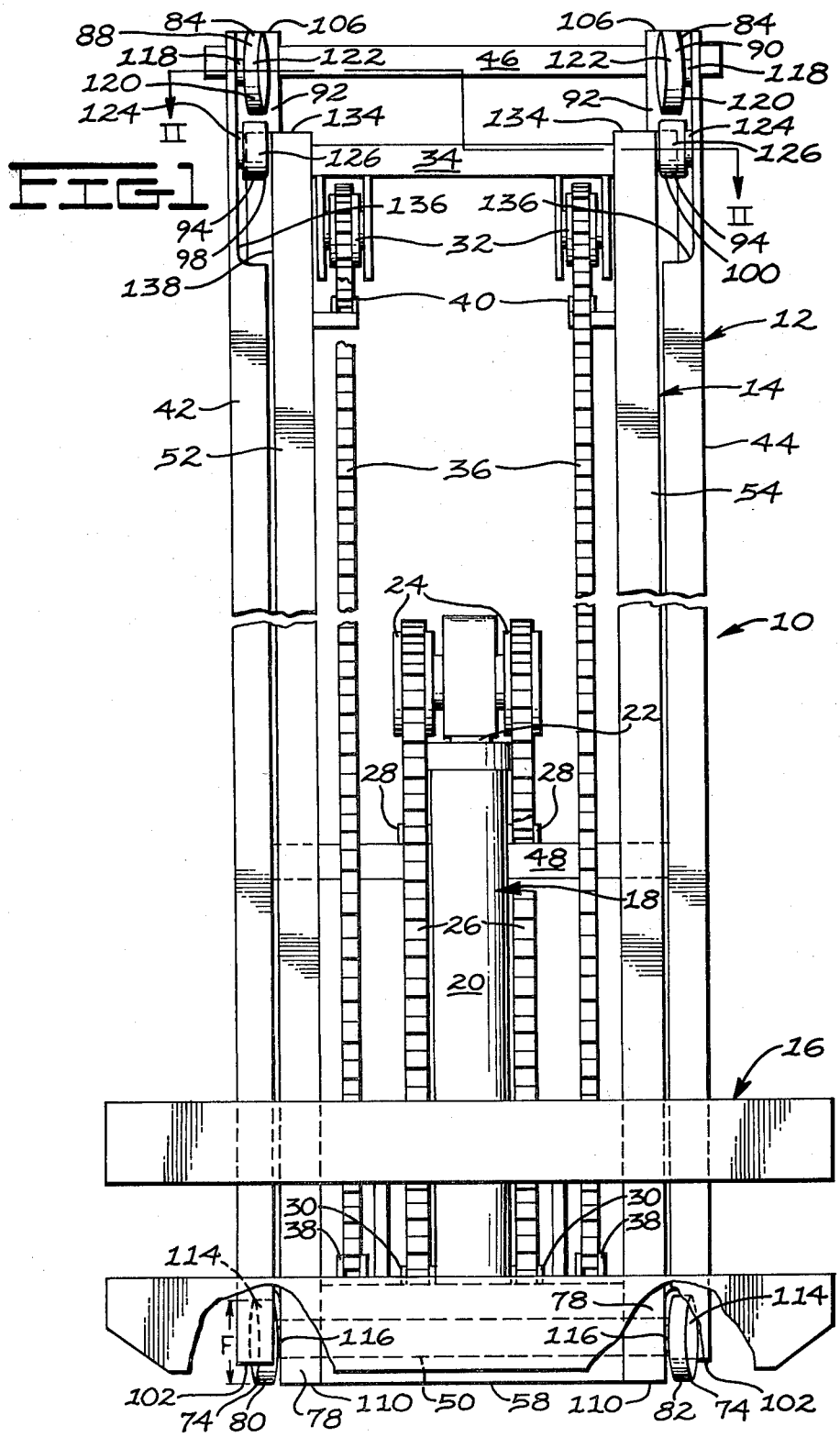
FIG. 1 is a diagrammatic front elevational view of the lift mast showing the second uprights and carriage in the fully lowered position.

Referring to the drawings, a lift mast assembly 10 for a vehicle such as a lift truck (not shown) has a fixed pair of spaced apart uprights 12 and a movable pair of spaced apart uprights 14 mounted on the fixed pair of uprights and elevationally extensibly movable relative thereto. A carriage 16 is mounted on the movable pair of uprights in a conventional manner well known in the art and elevationally movable relative to the movable pair of spaced apart uprights.

A hydraulic jack 18 having a cylinder 20 and rod 22 is provided for elevationally moving the carriage 16 and the movable pair of spaced apart uprights 14 is mounted on the fixed uprights 12. A first pair of sheaves 24 are connected to the rod 22 of the hydraulic jack 18 and a first pair of flexible members 26, such as chains, are trained over respective ones of the first pair of sheaves 24 and connected at a first end 28 to the fixed upright and at a second end 30 to the movable pair of uprights 14.

A second pair of sheaves 32 are connected to a tie bar 34 at transversely spaced-apart locations thereon. Each sheave of the pair 32 is located between the movable pair of uprights and closely adjacent a respective upright of said movable pair 14 to provide an open space therebetween and enhance visibility therethrough. A second pair of flexible members 36, such as chains, are trained over a respective one of the second pair of sheaves 36 and connected at a first end 38 to the carriage assembly 16 and at a second end 40 to the fixed pair of spaced-apart uprights 12.

Therefore, extension or retraction of the hydraulic jack 18 will cause elevational movement of the movable uprights through movement of the first pair of flexible members 26 and elevational movement of the carriage 16 in response to movement of the second pair of flexible members 36.

Uprights 42 and 44 of the fixed pair 12 are interconnected by upper, intermediate, and lower tie bars 46, 48, and 50. These tie bars maintain the uprights 42 and 44 at a fixed preselected spaced-apart distance from one another. The tie bars 46,48, and 50 are preferably welded to the uprights.

Uprights 52 and 54 of the movable pair 14 are interconnected by the upper and a lower tie bar 34 and 58. These tie bars maintain the uprights 52 and 54 at a preselected spaced distance one from the other. The tie bars 34,58 are preferably welded to these uprights.

With reference particularly to FIG. 2, the uprights 42 and 44 are preferably C-shaped channel members having first and second spaced-apart flanges 60 and 62 interconnected by a web 64. The uprights 52 and 54 are preferably "J" shaped beam members having first and second spaced-apart flanges 66 and 68 interconnected by a web 70. Each of the flanges 60, 62, 66, and 68 define a bearing surface 72 for guiding the movable pair of uprights 14 along the fixed pair of uprights 12 and the carriage 16 along the movable uprights 14.

A pair of lower guide bearings 74 which are preferably a pair of cylindrical load rollers are connected to the movable pair of uprights 14 at a lower end portion 78 thereon. One lower load roller 80 of the lower pair 74 is connected to the web 70 of the movable upright 52 and the other load roller 82 of the lower pair 74 is connected to the web 70 of the other movable upright 54. Both rollers 80 and 82 are connected at the lower end portion of its respective upright at preferably the same elevational location.

A pair of upper guide bearings 84, which are preferably an upper pair of cylindrical load rollers, are connected to the fixed pair of spaced-apart uprights. Specifically, each load roller 88 and 90 of the upper pair 84 is connected to a respective one of the uprights 42 and 44 of the fixed pair of uprights 12 at an upper end portion 92 thereon.

An intermediate pair of guide bearings 94 which are preferably a pair of intermediate cylindrical load rollers are connected to the fixed pair of spaced-apart uprights 12. Specifically, each intermediate cylindrical load roller 98 and 100 is connected to a respective one of the fixed uprights 42 and 44 at the upper end portion 92 thereon. The intermediate load roller 98 which is connected to the fixed upright 42 is elevationally positioned between the upper load roller 88 and a lower end 102 of the fixed pair 12 and the intermediate load roller 100 which is connected to upright 44 is elevationally positioned between the upper load roller 90 and the lower end 102 of the fixed pair 12. Preferably, upper load rollers 88 and 90 are spaced beneath and do not extend past an upper end 106 of the uprights 42 and 44 of the fixed pair of uprights 12. Similarly, the lower load rollers 80 and 82 do not extend past a lower end 110 of the uprights 52 and 54 of the movable pair of uprights 14. It is to be noted that substitutes for the upper, intermediate and lower guide bearing rollers may include slide bearing blocks or strips, or other well known anti-friction devices.

Each of the lower load rollers 80 and 82 have a wheel 114 and an axle shaft 116 upon which the wheel is rotatably mounted. The shaft 116 of load roller 80 is welded to the web 70 of movable upright 52 and the shaft 116 of lower load roller 82 is welded to the web 70 of movable upright 54. Load roller 80 is positioned between the webs 64 and 70 of uprights 42 and 52 and between the bearing surfaces 72 of flanges 60 and 62 of upright 42. Lower load roller 82 is positioned between the web 64 of the fixed upright 44 and the web 70 of the movable upright 54 and between the bearing surfaces 72 of flanges 60 and 62 of the fixed upright 44. The bearing surfaces 72 of fixed upright 42 and the bearing surfaces 72 of the fixed upright 44 define a pair of track ways for guiding the lower load rollers 80 and 82 along the uprights 42 and 44. It is to be noted that during normal operation load rollers 80 and 82 contact only the bearing surface 72 of flange 60 of their respective fixed uprights 42 and 44. The lower load rollers 80 and 82 are each preferably canted in a direction so as to engage the bearing surface 72 of flange 60 at a location closely adjacent a corner at the intersection of the web 64 and flange 60.

Upper load rollers 88 and 90 each have an axle shaft 118 and a wheel 120 rotatably mounted on the axle shaft. The axle shafts 118 of upper load rollers 88 and 90 are connected to web 64 of their respective fixed uprights 42 and 44 by welding. Upper load rollers 88 and 90 are both positioned at the same elevational location on their respective uprights 42 and 44 Preferably an outer peripheral surface 122 of each of said rollers does not extend past the upper end 106 of their respective uprights. Upper load roller 88 is disposed between webs 64 and 70 of the fixed upright 42 and movable upright 52 and engageable with bearing surface 72 of flange 66 of movable upright 52. Upper load roller 90 is positioned between web 64 of fixed upright 44 and web 70 of movable upright 54 and engageable with the bearing surface 72 of flange 66 of movable upright 54. Both rollers 88 and 90 are preferably canted in a direction towards the web 70 of its respectively adjacent movable upright 52,54 so as to engage the bearing surface 72 at a location closely adjacent the intersection of the web 70 and the flange 66.

The intermediate cylindrical load rollers 98 and 100 each have an axle shaft 124 and a wheel 126 rotatably mounted on the axle shaft 124. The axle shaft of intermediate roller 98 is connected to web 64 of fixed upright 42 by welding and the axle shaft 124 of intermediate roller 100 is connected to the web 64 of fixed upright 44 by welding. Both rollers 98 and 100 are located a preselected distance "D" from their adjacent upper roller 88 and 90 (FIG. 3). Distance "D" is preferably the elevational distance between an axis of rotation "U" of the upper guide rollers 88 and 90 and the axis of rotation "I" of the intermediate guide rollers 98 and 100. This distance "D" is greater than one-half the sum total of a diameter "A" of one of the upper guide rollers 88 and 90 and a diameter "B" of one of the intermediate guide rollers 98 and 100 but less than the sum total of the diameters "A" and "B" of one of the upper guide rollers 88 and 90 and one of the intermediate guide rollers 98 and 100. Intermediate guide roller 98 is positioned between the web 64 of fixed upright 42 and web 70 of movable upright 52 and contactable with the bearing surface 72 of flange 66. Similarly, intermediate guide roller 100 is positioned between web 64 of fixed upright 44 and web 70 of movable upright 54 and contactable with bearing surface 72 of flange 66 of movable upright 54.

The diameter "A" of each of the upper guide rollers 88 and 90 are substantially identical. Likewise, the diameter "B" of the intermediate guide rollers 98 and 100 are substantially identical. However, the diameter "B" of the intermediate guide rollers 98 and 100 is smaller in magnitude than the diameter "A" of the upper guide rollers 88 and 90. This permits the intermediate guide rollers 98 and 100 to be located on their respective webs 70 with substantially looser manufacturing tolerances than usual, promotes stronger upright sections and ease of disassembly of the movable pair of uprights 14 from its nested arrangement with the fixed pair of spaced-apart uprights 12. These advantages will be explained in greater detail in subsequent discussion.

As best seen in FIG. 3, the upper guide rollers 88 and 90 are mounted on their respective webs 64 so that the outer peripheral surface 122 is a preselected distance "C" from the bearing surface 72 of flange 60 at a location 128 on the peripheral surface 122 closest to surface 72. Location 128 is a point of tangency on the peripheral surface 122 defined by contact between the bearing surface 72 of uprights 52,54 and the peripheral surface 122 of rollers 88 and 90.

The intermediate load rollers 98 and 100 are each mounted on their respective webs 64 with a location 130 on an outer peripheral surface 132 being spaced from the bearing surface 72 a preselected distance "E". Location 130 is a point of tangency on the peripheral surface 132 defined by contact between the bearing surface 72 of uprights 52,54 and the peripheral surface 132 of rollers 98 and 100 which is closest to the surface 72 of flange 60. The magnitude of distance "E" is larger than the magnitude of distance "C". The significance of this difference in magnitude will be explained in greater detail in subsequent discussion.

Fixed uprights 42 and 44 each have the same predetermined length and movable uprights 52 and 54 each have the same predetermined length. Movable uprights 52 and 54, however, are preferably shorter in length than fixed uprights 42 and 44. In the lowered position of the movable pair of uprights 14, the lower end 110 of the uprights 52 and 54 extend past the lower end 102 of fixed uprights 42 and 44 and the upper end 106 of fixed uprights 42 and 44 extend past an upper end 134 of movable uprights 52 and 54. At the lowered position of the movable pair of uprights 14, the intermediate guide rollers 98 and 100 bear against the bearing surface 72 of flange 66 of their adjacent movable uprights 52 and 54. When the movable pair of uprights 14 is elevated to a position wherein the bearing surface 72 of flange 66 contacts the outer peripheral surface 122 of the upper rollers 88 and 90, the bearing surface 72 is moved away from contact with the intermediate load rollers 98 and 100 due to the difference in the spacing dimensions "C" and "E" from the flange 60. This is important as the upper load rollers 88 and 90 are larger and capable of supporting a greater amount of load than the smaller intermediate pair of load rollers 94. Therefore, the intermediate load rollers 98 and 100 only supports the movable pair of uprights 14 during elevational movement through a fast preselected distance between the lowered position and intermediate position where the bearing surface 72 of flange 66 contacts the upper load rollers 88 and 90. This distance is preferably equal to the previously noted distance "D" which was defined as the distance between the axis of rotation of the adjacent upper and intermediate load rollers.

In the lowered position as previously discussed, the upper end 134 of the movable pair of uprights 14 is spaced below and from the upper end 106 of the fixed pair of spaced-apart uprights 12. This spacing establishes the amount of free lift of the carriage 116. Since the movable pair of uprights 14 are allowed to move a predetermined distance, from the lowered position without passing the upper end 106 of the fixed pair of uprights 12, elevational movement of the carriage in response to movement of the uprights 14 within this range of movement is free lift. In the embodiment shown in the figs., this free lift range is equal to twice the elevational distance between the upper end 134 and 106 with the movable uprights in the lowered position.

A cutout 136 is provided in flanges 62 of each of the fixed uprights 42 and 44. These cutouts extend from the upper end 106 of uprights 42 and 44 respectively to a location spaced from the upper end and past the intermediate rollers 98 and 100. The length of the cutouts 136 is primarily determined by a diameter "F" of the lower load rollers 80 and 82 since these rollers must be able to pass through the cutout opening when the intermediate guide rollers 98 and 100 are removed from their axle shafts 124. Since the intermediate load rollers 98 and 100 are smaller in diameter than the upper load rollers, the intermediate rollers can be nested closer to the upper load rollers which will permit the cutouts to be of a shorter length than if both the intermediate and the upper load rollers were of the same diameter. Therefore the strength of the fixed uprights 42,44 will be increased. Also the amount of extension of the movable pair of uprights 14 is maximized since full extension is determined by contact between the upper and intermediate pair of rollers 84 and 94.

INDUSTRIAL APPLICABILITY

In operation and with reference to the figures lift mast 10 is shown with the movable pair of uprights 14 in the lowered position. Actuation of hydraulic jack 18 will cause the rod 22 to extend from cylinder 20 and lift the movable uprights 14 through the first pair of flexible members 26 and carriage 16 through the second pair of flexible members 36. It is to be noted that the movable uprights move in response to extension of the jack 18 and the carriage moves in response to elevational movement of the movable uprights 14. In the lowered position the movable pair of uprights 14 is supported and guided by the intermediate guide rollers 98 and 100 through contact between peripheral surface 132 of the rollers and surface 72 of flanges 60. The intermediate guide rollers 98 and 100 support the movable uprights 14 during movement through the first preselected distance until the upper end 134 of the movable uprights has moved past the intermediate elevated position at which the bearing surface 72 of flange 66 of the movable upright 14 is contacted by the peripheral surface 122 of the upper guide rollers 88 and 90. As the movable pair of uprights 14 elevationally move past the first preselected range of distance they make contact with the upper pair of load rollers 84 the bearing surface 72 will move away from contact with the intermediate pair of load rollers 94 thereby removing loads imposed upon them by the movable pair of uprights 14. Subsequent elevational movement of the movable pair of uprights 14 through a second preselected elevational distance to a fully extended position is guided by the upper pair of load rollers 84 and any further loads imposed upon the movable pair of uprights 14 will be directed to the upper pair of load rollers 84.

It is to be noted that movement of the movable pair of uprights 14 between the lowered position and a position wherein the upper end 134 of the movable pair of uprights is at the same elevational position as the upper end 106 of the fixed pair of uprights 12 is considered a free lift range of movement since the carriage can be elevationally moved in this range without extending the overall height of the mast assembly 10.

Therefore, it can be seen that the intermediate pair of load rollers 94 only supports the movable pair of uprights 14 at low elevational positions, within the first range of movement, wherein the load imposed on the rollers is at a minimum. At higher elevational positions of the movable pair of uprights 14 and within the second range of movement the load imposed by the movable pair of uprights 14 is directed to the upper pair of load rollers 84 and the intermediate pair of load rollers 94 are free from contact and loading by the movable pair of uprights 14. Further, the canting of the upper pair of load rollers 84 allows these rollers 84 to resist any side thrust imposed thereon by the movable pair of uprights. The intermediate pair of guide rollers 96 and therefore free from side loading.

The fully extended position of the movable pair of uprights 14, at the uppermost position of the second preselected range of distance, is determined by the location of the intermediate pair of guide rollers 94 on the fixed pair of uprights 12 and the lower pair of guide rollers 74. The closer the lower pair of guide rollers 74 are to the lower end 110 of the movable uprights 14 and the intermediate guide rollers 94 to the upper end 106 of the fixed pair of uprights 12 the greater the amount of extension of the movable pair of uprights. This is the case since the amount of extension of the movable upright 14 requires a preselected amount of distance be maintained between the upper 84 and lower 74 pair of rollers at the fully extended position to insure stiffness and reduce play of the movable pair of uprights 14.

Since the cutout 136 is kept at a minimum, the strength of the fixed pair of uprights 12 is at a maximum thereby reducing bending, flexing and breaking of the uprights under heavily loaded conditions.

Therefore it can be seen that the lift mast 10 offers improved visibility with the added free lift capabilities, while providing a maximum overall lift height through roller spacing, increased upright strength through a reduction in cutout dimension, and sequenced roller loading for improved roller life while keeping the quantity of parts and complexity of construction at a minimum.

Other aspects, objects and advantages of the invention of the embodiment described herein can be obtained from a study of the drawings, disclosure and appended claims.

I claim:

1. In a lift mast assembly (10) having a fixed upright (42) and a movable upright (52) mounted on said fixed upright (42) and elevationally movable relative thereto, said fixed upright (42) having first (60) and second (62) spaced apart elongate flanges and an upper (92) end portion, said movable upright (52) having first (66) and second (68) spaced apart elongate flanges and a lower (78) end portion, said movable upright (52) having a lower guide bearing (80) mounted on the lower end portion (78) thereof and contactably engaged with one of the first and second spaced apart flanges (60,62) of said fixed upright (42), and said fixed upright (42) having an upper guide bearing (88) mounted on the upper end portion (92) thereof; the improvement comprising:

an intermediate guide bearing (98) mounted on said fixed upright (42) at the upper end portion (92) thereof at a preselected elevationally spaced distance ("D") from said upper guide bearing (88) and between said upper (88) and lower (80) guide bearings;

said movable upright (52) being elevationally movable a first preselected distance, between a lowered position and an intermediate position, at which one of said first and second spaced apart elongate flanges (66,68) of the movable upright (52) is contactably engaged with the intermediate guide bearing (98) and said first and second spaced apart elongate flanges (66,68) of the movable upright (52) are free from contact with said upper guide bearing (88); and said movable upright (52) being elevationally movable a second preselected distance, between said intermediate position and a fully raised position, at which one of said first and second spaced apart elongate flanges (66,68) of said movable upright (52) is contactably engaged with the upper guide bearing (88) and both of the first and second spaced apart elongate flanges (66,68) of the movable upright (52) are free from contact with the intermediate guide bearing (98).

2. A lift mast assembly (10) as set forth in claim 1 wherein each of said fixed (42) and movable (52) uprights have an upper (106,134) and lower (102,110) end, said upper end (106) of the fixed upright (42) extends to a location past the upper end (134) of the movable upright (42) at said lowered position of said movable upright (52).

3. A lift mast assembly (10) as set forth in claim 2 wherein said lower end (110) of the movable upright (52) extends past the lower end (102) of the fixed upright (42) at the lowered position of the movable upright (52).

4. A lift mast assembly (10) as set forth in claim 2 wherein each of said lower (80), intermediate (98) and upper (88) guide bearings include:

an axle shaft (116,124,118) and a wheel (114,126,120), said wheels (114,126,120) being removably mounted on their respective axle shaft (116,124,118) and rotatable about said respective axle shaft (116,124,118), said axle shaft (118) defining an axis of revolution (U) about which said upper wheel (120) rotates and said axle shaft (124) defining an axis (I) of revolution about which said intermediate wheel (126) rotates.

5. A lift mast assembly (10) as set forth in claim 4 wherein said first and second spaced apart flanges (60,62,66,68) of each of said fixed and movable uprights (42,52) are interconnected by a web (64,70);

said first and second flanges (60,62,66,68) of the fixed and movable uprights (42,52) each have a bearing surface (72), said bearing surface (72) of first flange (66) of movable upright (52) being contactable by the wheels (120,126) of the upper and intermediate guide bearings (88,98) and said bearing surface (72) of flange (60) of said fixed upright (42) being contactable by the wheel (114) of the lower guide bearing (80); and said upper guide bearing (88) being canted in a direction toward the web (70) of the movable upright (52) at a juncture of the interconnection of the web (70) and the first flange (66) thereof.

6. A lift mast assembly (10) as set forth in claim 5 wherein said intermediate guide bearing wheel (126) has a flange contacting peripheral surface (132), said peripheral surface (130) being oriented substantially normal to at least one of the webs (64,70) of the fixed and movable uprights (42,52) and substantially parallel to the flange bearing surface (72) of the first flange (66) of the movable upright (52).

7. A lift mast assembly (10) as set forth in claim 5 wherein said lower guide bearing (80) is canted in a direction opposite that of the upper guide bearing (88) and toward the web (64) of the fixed upright (42) at a juncture of the interconnection of the web (64) and the first flange (60) thereof.

8. A lift mast assembly (10) as set forth in claim 4 wherein said wheels (120,126,114) of the upper (88) and intermediate (98) and lower (80) guide bearings each have a preselected diameter (A,B,F), and the diameter (B) of the wheel (126) of the intermediate guide bearing (98) being of a smaller magnitude than the diameter (A) of the wheel (120) of the upper guide bearing (88).

9. A lift mast assembly (10) as set forth in claim 8 wherein said first preselected distance of movement of the movable upright (52) is less than the elevational distance (D) between the rotational axes (U,I) defined by the upper and intermediate axle shafts (118,124).

10. A lift mast assembly (10) as set forth in claim 8 wherein said first and second flanges (60,62) of said fixed upright (42) are interconnected by a web (64) and said axle shafts (124,118) of the intermediate (98) and the upper (88) guide bearings are affixed to the web (64) of the fixed upright (42), and said preselected elevational distance (D) between the upper (88) and intermediate (92) guide bearings being the elevational distance (D) between the axes of rotation (U,I) of the upper and intermediate wheels (120,126) of the axle shafts (118,124) of the upper and intermediate guide bearings (88,98).

11. A lift mast assembly (10) as set forth in claim 10 wherein said upper guide bearing wheel (120) has an outer peripheral surface (122) and said intermediate guide bearing wheel (126) has an outer peripheral surface (132); said upper guide bearing outer peripheral surface (122) being spaced from said first flange (60) of said fixed upright (42) a preselected distance (C) at a location (128) on said surface (122) closest the first flange (60); and said intermediate guide bearing outer peripheral surface (132) being spaced from said first flange (60) of said fixed upright (42) a preselected distance (E) at a location (130) on said surface (132) closest the first flange (60), said preselected distance of the peripheral outer surface (122) from first flange (60) being smaller in magnitude than the preselected distance of the peripheral surface (132) from the first flange (60).

12. A lift mast assembly (10) as set forth in claim 10 wherein said elevational distance (D) between the rotational axis (U) defined by the upper guide bearing axle shaft (118) and the axis (I) defined by the intermediate guide bearing axle shaft (124) is greater than one half the sum total of the diameters (A,B) of the wheels (120,126) of the upper (88) and intermediate (98) guide bearings and less than the sum total of the diameters (A,B) of the wheels (120,126) of the upper (88) and intermediate (98) guide bearings.

13. A lift mast assembly (10) as set forth in claim 12 wherein said second flange, (62) at the upper end portion (92) of the fixed upright (42), has a cutout (136) disposed therein, said cutout (136) extends from the upper end (106) to a location past said intermediate guide bearing (98) and toward said lower end (102) thereof, said cutout (136) providing an opening sufficient to pass said lower guide bearing wheel (114) therethrough when said intermediate guide bearing wheel (126) is removed from the intermediate guide bearing axle shaft (124).

14. A lift mast assembly (10) as set forth in claim 13 wherein said cutout (136) extends to a location past the axle shaft (124) of the intermediate guide bearing (98) a distance at least equal to the diameter (F) of the lower guide bearing wheel (114).

15. In a lift mast assembly (10) having a fixed pair of spaced apart uprights (12), a movable pair of spaced apart uprights (14) mounted on said fixed pair and elevationally extensibly movable relative thereto between a lowered position and an extended position, and a carriage (16) mounted on said movable pair of uprights (14) and elevationally movable relative thereto, each of said uprights (42,44,52,54) of said fixed and movable pair (12,14) have first (60,66) and second (62,68) spaced apart load bearing flanges interconnected by a web (64,70), each of said uprights (42,44,52,54) of said fixed (12) and movable (14) pair have an upper (106,134) and lower (102,110) end, said movable pair of uprights (14) has a lower end portion (78) and said fixed pair of uprights (12) has an upper end portion (92), a lower pair of cylindrical load rollers (74), one load roller (80) of said lower pair (74) being connected to the web (70) of one upright (52) of the movable pair (14) at the lower end portion (78) thereon, said one load roller (80) being contactably engaged with one of said first (60) and second (62) flanges of one upright (42) of the fixed pair (12) and the other load roller (82) of said lower pair (74) being connected to the web (70) of the other upright (54) of the movable pair (14) at the lower end portion (78) thereon, said other load roller (82) being contactably engaged with one of said first and second flanges (60,62) of the other upright of the fixed pair (12); the improvement comprising:

an upper pair of cylindrical load rollers (84) each having a preselected diameter (A), one of said rollers (88) of the upper pair (84) being connected to the web (64) of one of said uprights (42) of the fixed pair (12) at the upper end portion (92) thereon and the other of said rollers (90) of said upper pair (84) being connected to the web (64) of the other of said uprights (44) of the fixed pair (12) at the upper end portion (92) thereon;

an intermediate pair of cylindrical load rollers (94), one of said rollers (98) of said intermediate pair (94) being connected to the web (64) of one of said uprights (42) of the fixed pair (12) at the upper end portion (92) thereon and between said upper (88) and lower (80) rollers, and the other (100) of said rollers of the intermediate pair (94) being connected to the web (64) of the other (44) of said uprights of the fixed pair (12) at the upper end portion (92) thereon and between said upper (90) and lower (82) rollers; and said movable pair of uprights (14) being elevationally movable a first preselected distance from said lowered position at which said intermediate pair of rollers (94) are engaged with one of said first (66) and second (68) flanges of the movable pair (14) of uprights and said upper pair of rollers (84) are free from contact with the first (66) and second (68)

flanges of the movable pair of uprights (14), said movable pair of uprights (14) being elevationally movable a second preselected distance to said fully elevated position at which said intermediate pair of rollers (94) are free from contact with the first (66) and second (68) flanges of the movable pair of uprights (14) and said upper pair of rollers (84) are engaged with one of said first (66) and second (68) flanges of the movable pair (14) of uprights.

16. A lift mast assembly (10) as set forth in claim 15 wherein said upper end (106) of the fixed pair of uprights (12) extends past the upper end (134) of said movable pair of uprights (14), at said lowered position of said movable pair of uprights (14).

17. A lift mast assembly (10) as set forth in claim 16 wherein said lower end (110) of the movable pair of uprights (14), at said lowered position extends past the lower end (102) of said fixed pair of uprights (12).

18. A lift mast assembly (10) as set forth in claim 15 wherein said preselected diameter (B) of the intermediate pair of rollers (94) is smaller in magnitude than the preselected diameter (A) of the upper pair of rollers (88).

19. A lift mast assembly (10) as set forth in claim 18 wherein said upper pair of rollers (84) have an axis of rotation (U) and said intermediate pair of rollers (94) have an axis of rotation (I), said upper pair of rollers (84) being elevationally spaced from said intermediate pair of rollers (94) a distance less than the sum total of the diameter (A) of one of the upper rollers (88,90) and the diameter (B) of one of the intermediate rollers (98,100) and a distance greater than one-half the sum total of the diameter (A) of one of the upper rollers (88,90) and the diameter (B) of one of the intermediate rollers (98,100).

20. A lift mast assembly (10) as set forth in claim 19 wherein said rollers (88,90) of the upper pair (84) each have an outer peripheral surface (122) and said rollers (98,100) of the intermediate pair each have an outer peripheral surface (132), said outer peripheral surface of the rollers (88,90) of the upper pair being positioned closer to the first flange (60), at a location (128) on the peripheral surface (122) closest the flange (60), than the outer peripheral surface of the rollers (98,100) of the intermediate pair, at a location (130) on the peripheral surface (132) closest the flange (60).

21. A lift mast assembly (10) as set forth in claim 18 wherein said intermediate pair of guide rollers (94) are removably mounted on their respective webs (64), and said second flange (62) of the uprights (42,44) of said fixed pair (12) each have a cutout (136) disposed therein, said cutouts (136) extend from the upper end (106) of said uprights (42,44) toward the lower end (102) to a location past said intermediate guide rollers (98,100), said cutout providing an opening sufficient to pass said lower guide rollers (80,82) therethrough only with said intermediate guide rollers (98,100) removed.

* * * * *